US008570265B2

(12) United States Patent
Jung et al.

(10) Patent No.: US 8,570,265 B2
(45) Date of Patent: Oct. 29, 2013

(54) LIQUID CRYSTAL DISPLAY AND DRIVING METHOD THEREOF

(75) Inventors: Kwang-Chul Jung, Seongnam-si (KR); Mee-Hye Jung, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1286 days.

(21) Appl. No.: 12/243,560

(22) Filed: Oct. 1, 2008

(65) Prior Publication Data

US 2009/0190052 A1 Jul. 30, 2009

(30) Foreign Application Priority Data

Jan. 29, 2008 (KR) ..... 10-2008-0008998

(51) Int. Cl.
*G09G 3/36* (2006.01)

(52) U.S. Cl.
USPC ..... 345/96; 345/87; 345/88; 345/89; 345/90; 349/37; 349/39; 349/144

(58) Field of Classification Search
None
See application file for complete search history.

(56) References Cited

U.S. PATENT DOCUMENTS

| | | | | |
|---|---|---|---|---|
| 6,115,018 | A * | 9/2000 | Okumura et al. | 345/95 |
| 2006/0097972 | A1* | 5/2006 | Takeuchi et al. | 345/90 |
| 2006/0119755 | A1* | 6/2006 | Senda et al. | 349/38 |
| 2006/0284811 | A1* | 12/2006 | Huang | 345/92 |
| 2007/0013854 | A1 | 1/2007 | Yoo et al. | |
| 2007/0109238 | A1 | 5/2007 | Lee et al. | |
| 2007/0132899 | A1* | 6/2007 | Cheng et al. | 349/38 |
| 2008/0074377 | A1* | 3/2008 | Fujita | 345/96 |

FOREIGN PATENT DOCUMENTS

| | | |
|---|---|---|
| CN | 1808555 | 7/2006 |
| CN | 1928674 | 3/2007 |
| CN | 1983369 | 6/2007 |
| JP | 2004-078157 | 3/2004 |
| JP | 2005-250085 | 9/2005 |
| JP | 2007-156379 | 6/2007 |
| JP | 2008-15512 | 1/2008 |
| KR | 1020030008044 | 1/2003 |
| KR | 100552364 | 2/2006 |
| KR | 1020050060730 | 6/2006 |
| KR | 1020060091064 | 8/2006 |
| KR | 1020070067940 | 6/2007 |
| KR | 1020070070330 | 7/2007 |
| KR | 1020070071319 | 7/2007 |
| KR | 1020070082412 | 8/2007 |

* cited by examiner

*Primary Examiner* — Sumati Lefkowitz
*Assistant Examiner* — Jose Soto Lopez
(74) *Attorney, Agent, or Firm* — F. Chau & Associates, LLC

(57) ABSTRACT

A liquid crystal display includes a first gate line transmitting a first gate signal, a first data line transmitting a first data voltage, and a first pixel connected to the first gate line and the first data line and including a first subpixel and a second subpixel. The first subpixel includes a first switching element connected to the first gate line, a first liquid crystal capacitor connected to the first switching element, and a first storage capacitor having a first terminal and a second terminal. The second subpixel includes a second switching element connected to the first gate line and the first data line, a second liquid crystal capacitor connected to the second switching element, and a second storage capacitor having a first terminal and a second terminal and having a capacitance different from a capacitance of the first storage capacitor. The first terminal of the first storage capacitor is connected to the first switching element, the first terminal of the second storage capacitor is connected to the second switching element, and the second terminal of the first storage capacitor and the second terminal of the second storage capacitor are coupled to each other and have a varying voltage thereof.

13 Claims, 6 Drawing Sheets

LIQUID CRYSTAL DISPLAY AND DRIVING METHOD THEREOF

CROSS-REFERENCE TO RELATED APPLICATION

This application claims priority to and the benefit of Korean Patent Application No. 10-2008-0008998 filed in the Korean Intellectual Property Office on Jan. 29, 2008, the entire contents of which are incorporated herein by reference.

BACKGROUND OF THE INVENTION (a) Technical Field

The present disclosure relates to a liquid crystal display and a driving method thereof.

(b) Discussion of Related Art

A liquid crystal display is one of the most popular flat panel displays. The liquid crystal display includes two display panels, each of which has field generating electrodes such as pixel electrodes and a common electrode, and a liquid crystal layer between the two display panels. The liquid crystal display displays images by determining alignments of liquid crystal molecules in the liquid crystal layer and controlling polarization of incident light through an electric field that is induced at the liquid crystal layer by applying a voltage to the field generating electrodes.

The liquid crystal display includes switching elements connected to each of the pixel electrodes, and a plurality of signal lines, such as gate lines and data lines, for applying a voltage to the pixel electrodes by controlling the switching elements.

Among the liquid crystal displays, a vertically aligned mode liquid crystal display has been receiving attention because of a large contrast ratio and a wide reference viewing angle. In the vertically aligned mode liquid crystal display, liquid crystal molecules are aligned to have major axes perpendicular to a display panel when an electric field is not being applied. The reference viewing angle denotes a viewing angle with a contrast ratio of 1:10, or denotes a critical angle for luminance reversal between grays.

In the case of the vertically aligned mode liquid crystal display, a pixel is divided into two subpixels, and transmittance of each subpixel is controlled by applying different voltages to the two subpixels in order to cause lateral visibility to be close to frontal visibility.

To control voltages of the two subpixels, a storage capacitor is introduced. It is difficult to use this method, however, because the structure and driving method thereof are too complicated.

SUMMARY OF THE INVENTION

An exemplary embodiment of the present invention provides a liquid crystal display including a first gate line transmitting a first gate signal, a first data line transmitting a first data voltage, and a first pixel connected to the first gate line and the first data line and including a first subpixel and a second subpixel. The first subpixel includes a first switching element connected to the first gate line, a first liquid crystal capacitor connected to the first switching element, and a first storage capacitor having a first terminal and a second terminal. The second subpixel includes a second switching element connected to the first gate line and the first data line, a second liquid crystal capacitor connected to the second switching element, and a second storage capacitor having a first terminal and a second terminal and having a capacitance different from a capacitance of the first storage capacitor. The first terminal of the first storage capacitor is connected to the first switching element, the first terminal of the second storage capacitor is connected to the second switching element, and the second terminal of the first storage capacitor and the second terminal of the second storage capacitor are coupled to each other and have a varying voltage.

The voltage of the second terminals of the first and second storage capacitors may be fixed while the first and second switching elements turn on to charge the first and second liquid crystal capacitors and the first and second storage capacitors. The voltage of the second terminals may vary after the charging of the first and second liquid crystal capacitors and the first and second storage capacitors is finished.

The voltage of the second terminals of the first and second storage capacitors may rise when the voltage stored in the first and second liquid crystal capacitors and the first and second storage capacitors has a positive polarity, and it may drop when the stored voltage has a negative polarity.

The second terminals of the first and second storage capacitors are always supplied with an external voltage.

The liquid crystal display may further include a first storage electrode line that has a periodically varying voltage and is connected to the second terminals of the first and second storage capacitors.

The liquid crystal display may further include a second storage electrode line that has a voltage having a polarity opposite that of the voltage of the first storage electrode line, a second data line transmitting a second data voltage, and a second pixel connected to the first gate line and the second data line and comprising a third subpixel and a fourth subpixel. The third subpixel may include a third switching element connected to the first gate line and the second data line, a third liquid crystal capacitor connected to the third switching element, and a third storage capacitor connected between the third switching element and the second storage electrode line. The fourth subpixel may include a fourth switching element connected to the first gate line and the second data line, a fourth liquid crystal capacitor connected to the fourth switching element, and a fourth storage capacitor connected between the fourth switching element and the second storage electrode line and having a capacitance different from a capacitance of the third storage capacitor.

The second terminals of the first and second storage capacitors alternate between a voltage-biased state and a floating state.

The liquid crystal display may further include a first storage electrode line having a first voltage, a second storage electrode line having a second voltage that is different from the first voltage, and a second gate line transmitting the second gate signal. The first pixel may further include a third switching element connected to the first gate line, the first storage electrode line, and the second terminals of the first and second storage capacitors, and a fourth switching element connected to the second gate line, the second storage electrode line, and the second terminals of the first and second storage capacitors.

The third switching element may transfer the first voltage while the first and second liquid crystal capacitors and the first and second storage capacitors are charged, and the fourth switching element may be turned on to transfer the second voltage after the third switching element is turned off.

The liquid crystal display may further include a third gate line transmitting a third gate signal, and a second pixel connected to the second and third gate lines and the first data line and including a third subpixel a fourth subpixel, a fifth switching element, and a sixth switching element. The fifth switching element may be connected to the second gate line and the second storage electrode line, and the sixth switching element may be connected to the third gate line and the first storage electrode line. The third subpixel may include a seventh switching element connected to the second gate line and the first data line, a third liquid crystal capacitor connected to the seventh switching element, and a third storage capacitor connected between the fifth switching element and the seventh switching element. The fourth subpixel comprises an eighth switching element connected to the second gate line and the first data line, a fourth liquid crystal capacitor connected to the eighth switching element, and a fourth storage capacitor connected between the sixth switching element and the eighth switching element and having a capacitance different from a capacitance of the third storage capacitor.

The fifth switching element may transfer the second voltage while the third and fourth liquid crystal capacitors and the third and fourth storage capacitors are charged. The sixth switching element turns on to transfer the first voltage after the fifth switching element is turned off.

Voltages of the first, second, and third gate lines may vary sequentially.

An exemplary embodiment of the present invention provides a driving method of a liquid crystal device, including charging first and second liquid crystal capacitors and first and second storage capacitors with substantially the same voltage, floating first terminals of the first liquid crystal capacitor and the first storage capacitor that are connected to each other, and first terminals of the second liquid crystal capacitor and the second storage capacitor that are connected to each other, and changing voltages of the second terminals of the first and second storage capacitors by substantially the same level to cause voltages of the first terminal of the first liquid crystal capacitor and the first terminal of the second liquid crystal capacitor to be differentiated.

The capacitance of the first storage capacitor may be different from the capacitance of the second storage capacitor.

During the charging, the voltages of the second terminals of the first and second storage capacitors may be maintained at fixed levels.

The steps of changing voltages may include: raising the voltages of the second terminals of the first and second storage capacitors when the first and second liquid crystal capacitors and the first and second storage capacitors are charged with a positive voltage, and lowering the voltages of the second terminals of the first and second storage capacitors when the first and second liquid crystal capacitors and the first and second storage capacitors are charged with a negative voltage.

An external voltage may be always applied to the second terminals of the first and second storage capacitors.

The driving method may further include floating the second terminals of the first and second storage capacitors after the step of changing voltages.

BRIEF DESCRIPTION OF THE DRAWINGS

Exemplary embodiments of the present invention will be understood in more detail from the following description taken in conjunction with the attached drawings.

DETAILED DESCRIPTION OF EXEMPLARY EMBODIMENTS

The present invention will be described more fully hereinafter with reference to the accompanying drawings, in which exemplary embodiments of the invention are shown. As those of ordinary skill in the art would realize, the described exemplary embodiments may be modified in various different ways, without departing from the spirit or scope of the present invention.

Hereinafter, a liquid crystal display according to an exemplary embodiment of the present invention will be described with reference to FIG. 1 to FIG. 3.

Figure 1:
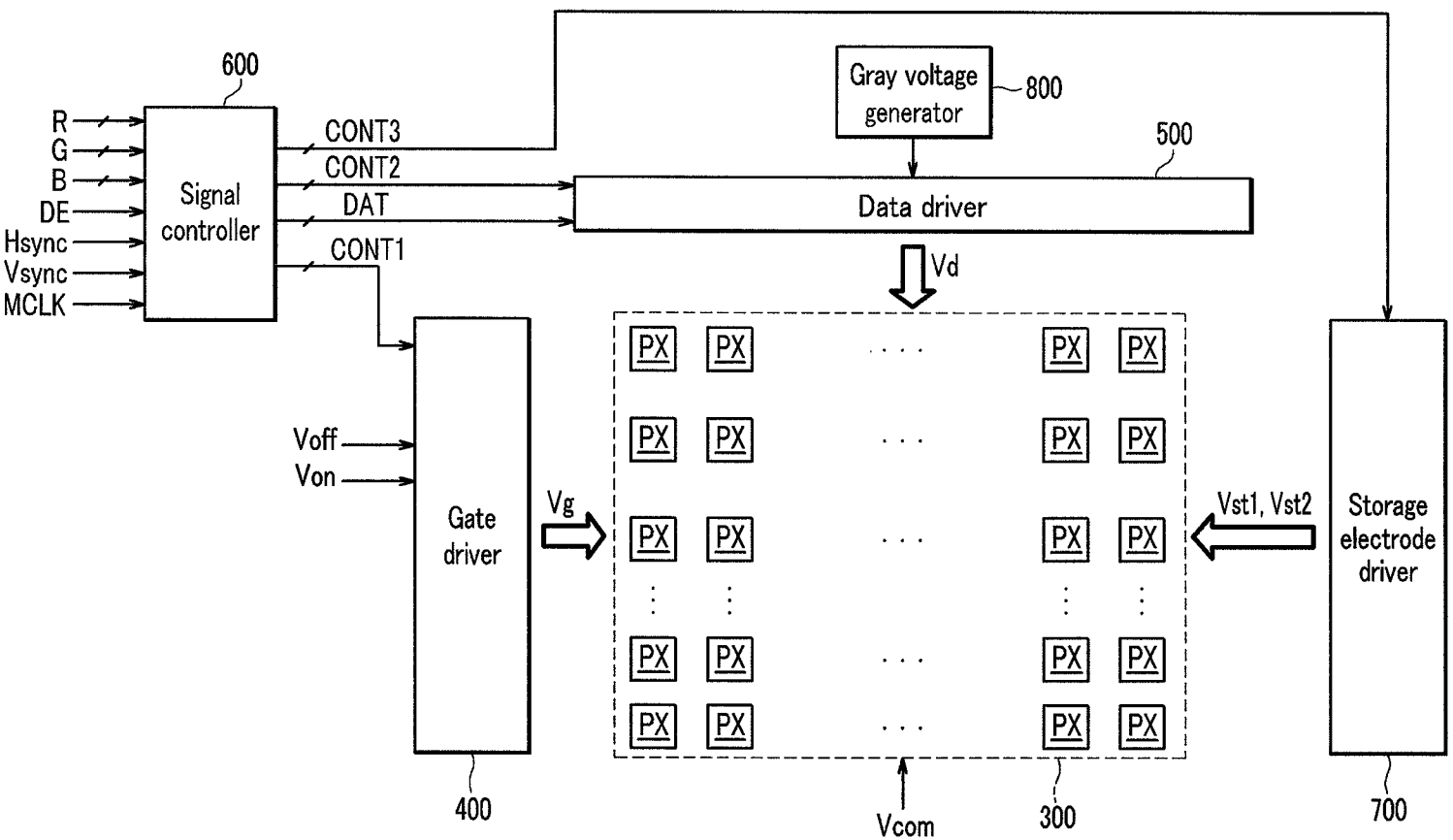
FIG. 1 is a block diagram of a liquid crystal display according to an exemplary embodiment of the present invention.
Figure 2:
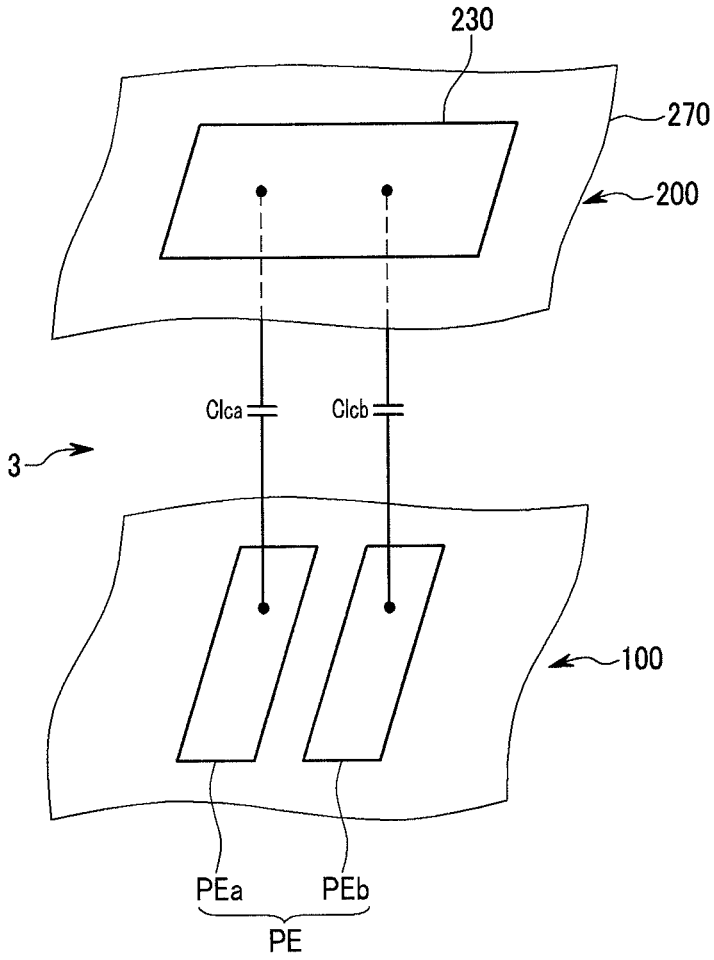
FIG. 2 is a schematic diagram illustrating a structure of a liquid crystal display and an equivalent circuit of two subpixels according to an exemplary embodiment of the present invention.
Figure 3:
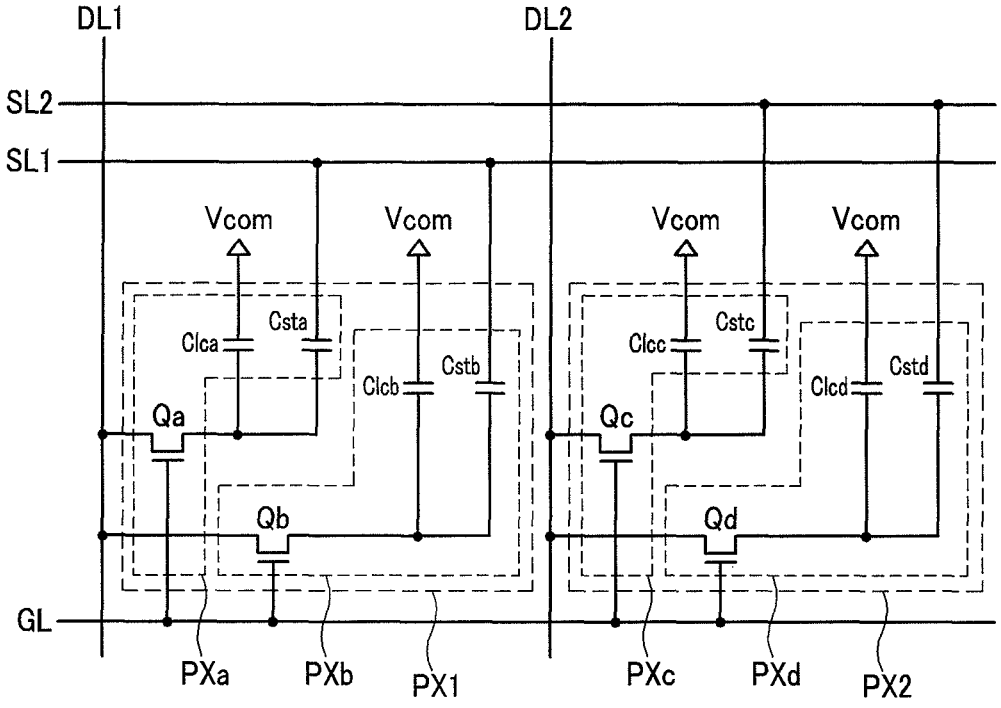
FIG. 3 is an equivalent circuit diagram of two pixels of a liquid crystal display according to an exemplary embodiment of the present invention.

FIG. 1 is a block diagram of a liquid crystal display according to an exemplary embodiment of the present invention, FIG. 2 is a schematic diagram illustrating a structure of a liquid crystal display and an equivalent circuit of two subpixels according to an exemplary embodiment of the present invention, and FIG. 3 is an equivalent circuit diagram of two pixels of a liquid crystal display according to an exemplary embodiment of the present invention.

As shown in FIG. 1, the liquid crystal display according to an exemplary embodiment of the present invention includes a liquid crystal panel assembly 300, a gate driver 400, a data driver 500, a storage electrode driver 700, a gray voltage generator 800, and a signal controller 600.

In an equivalent circuit, the panel assembly 300 includes a plurality of signal lines GL, DL1, DL2, SL1, and SL2 (see FIG. 3), and a plurality of pixels PX connected thereto and arranged in a matrix form. Further, the panel assembly 300 includes a lower panel 100 and an upper panel 200 facing each other with a liquid crystal layer 3 therebetween as shown in FIG. 2.

Referring to FIG. 3, the signal lines include a plurality of gate lines GL for transferring a gate signal, which may be referred to as a scanning signal, a plurality of data lines DL1 and DL2 for transferring data voltages Vd, and a pair of first and second storage electrode lines SL1 and SL2 for transferring storage electrode signals Vst1 and Vst2. The first and second storage electrode lines SL1 and SL2 are supplied with first and second storage electrode signals Vst1 and Vst2 that are periodic signals having opposite phases, respectively. The gate lines GL and the first and second storage electrode lines SL1 and SL2 extend generally in a row direction and are approximately parallel to each other. The data lines DL1 and DL2 extend generally in a column direction and are approximately parallel to each other.

Each pixel PX includes two subpixels. Each of the subpixels includes a switching element, a liquid crystal capacitor, and a storage capacitor. For example, each of pixels PX1 and PX2 includes two subpixels PXa and PXb and PXc and PXd, respectively and each of the subpixels PXa, PXb, PXc, and PXd includes a switching element Qa, Qb, or Qc, Qd, a liquid crystal capacitor Clca, Clcb, or Clcc, Clcd, and a storage capacitor Csta, Cstb, or Cstc, Cstd, as shown in FIG. 3.

Each of the switching elements Qa, Qb, Qc, and Qd is a three terminal element, such as a thin film transistor disposed in the lower panel 100. Each of the switching elements Qa, Qb, Qc, and Qd has a control terminal connected to the gate line GL, an input terminal connected to the data line DL1 or DL2, and an output terminal connected to the liquid crystal capacitor Clca, Clcb, Clcc, or Clcd and the storage capacitor Csta, Cstb, Cstc, or Cstd.

Referring to FIG. 2, each liquid crystal capacitor Clca and Clcb respectively includes a subpixel electrode PEa and PEb of the lower panel 100 and a common electrode 270 of the upper panel 200 forming two terminals. The liquid crystal layer 3 disposed between the subpixel electrodes PEa and PEb and the common electrode 270 functions as a dielectric of the liquid crystal capacitors Clca and Clcb. The two subpixel electrodes PEa and PEb are separated from each other and form a pixel electrode PE. The common electrode 270 covers an entire surface of the upper panel 200 and receives a common voltage Vcom. The liquid crystal layer 3 may have negative dielectric anisotropy, and liquid crystal molecules of the liquid crystal layer 3 may be aligned such that their major axes are perpendicular to the surfaces of the two display panels 100 and 200 in the absence of an electric field.

The liquid crystal capacitors Clcc and Clcd may have the same structures as the liquid crystal capacitors Clca and Clcb.

The storage capacitors Csta, Cstb, Cstc, and Cstd are respectively connected to the switching elements Qa, Qb, Qc, and Qd, and to the first and second storage electrode lines SL1 and SL2. Each of the storage capacitors Csta, Cstb, Cstc, and Cstd includes a subpixel electrode PEa or PEb and a storage electrode line SL1 or SL2, which is provided on the lower panel 100, overlaps the subpixel electrode PEa or PEb via an insulator.

In each of the pixels PX1 and PX2, the storage capacitors Csta and Cstb or Cstc and Cstd of the two subpixels PXa and PXb or PXc and PXd have different capacitances and are connected to the same storage electrode line SL1 or SL2. The storage capacitors Csta, Cstb, Cstc, and Cstd of adjacent pixels PX1 and PX2, however, are connected to different storage electrode lines SL1 and SL2.

For color display, each of the pixels PX uniquely represents one of the primary colors (spatial division) or each of the pixels PX sequentially represents the primary colors in turn (temporal division) such that the spatial or temporal sum of the primary colors are recognized as a desired color. An example of a set of the primary colors includes red, green, and blue colors. FIG. 2 shows an example of the spatial division in which each of the pixels PX includes a color filter 230 representing one of the primary colors in an area of the upper panel 200. Alternatively, the color filter 230 may be provided on or under the subpixel electrodes PEa and PEb of the lower panel 100.

Polarizers (not shown) are provided on outer surfaces of the display panels 100 and 200. The polarization axes of the two polarizers may orthogonally cross each other. In the case of a reflective liquid crystal display, one of the two polarizers may be omitted. The crossed polarizers block incident light entering into the liquid crystal layer 3 when no electric field is applied thereto.

Referring to FIG. 1 again, the gray voltage generator 800 generates a plurality of gray voltages or reference gray voltages related to the light transmittance of the pixels PX.

The gate driver 400 is connected to the gate line GL of the panel assembly 300, and synthesizes a gate-on voltage Von and a gate-off voltage Voff fed thereto to generate the gate signal Vg for application to the gate line GL.

The data driver 500 is connected to the data lines DL1 and DL2 of the panel assembly 300, and applies data voltages Vd, which are selected from the gray voltages supplied from the gray voltage generator 800, to the data lines DL1 and DL2. When the gray voltage generator 800 generates only a small number of the reference gray voltages rather than all the gray voltages, however, the data driver 500 may divide the reference gray voltages to generate the data voltages among the gray voltages.

The storage electrode driver 700 is connected to the first and second storage electrode lines SL1 and SL2, shown in FIG. 3, of the panel assembly 300, and applies a pair of storage electrode signals Vst1 and Vst2 having opposite phases to the first and second storage electrode lines SL1 and SL2. The storage electrode driver 700 may be embodied as a chip with the gate driver 400.

The signal controller 600 controls the gate driver 400, the data driver 500, and the storage electrode driver 700.

Each of the driving apparatus 400, 500, 600, 700, and 800 may include at least one integrated circuit (IC) chip (not shown) mounted on the panel assembly 300 or on a flexible printed circuit (FPC) film (not shown) in a tape carrier package (TCP) type, which is attached to the panel assembly 300. Alternatively, the driving apparatus 400, 500, 600, 700, and 800 may be mounted on an additional printed circuit board (PCB) (not shown). In an exemplary embodiment, at least one of the driving apparatus 400, 500, 600, 700, and 800 may be integrated into the panel assembly 300. Alternatively, the driving apparatus 400, 500, 600, 700, and 800 may be integrated into a single IC chip. In this case, at least one of circuit elements may be disposed outside of the single IC chip.

Hereinafter, the operation of a liquid crystal display according to an exemplary embodiment of the present invention will be described in detail with reference to FIG. 1 to FIG. 4.

Figure 4:
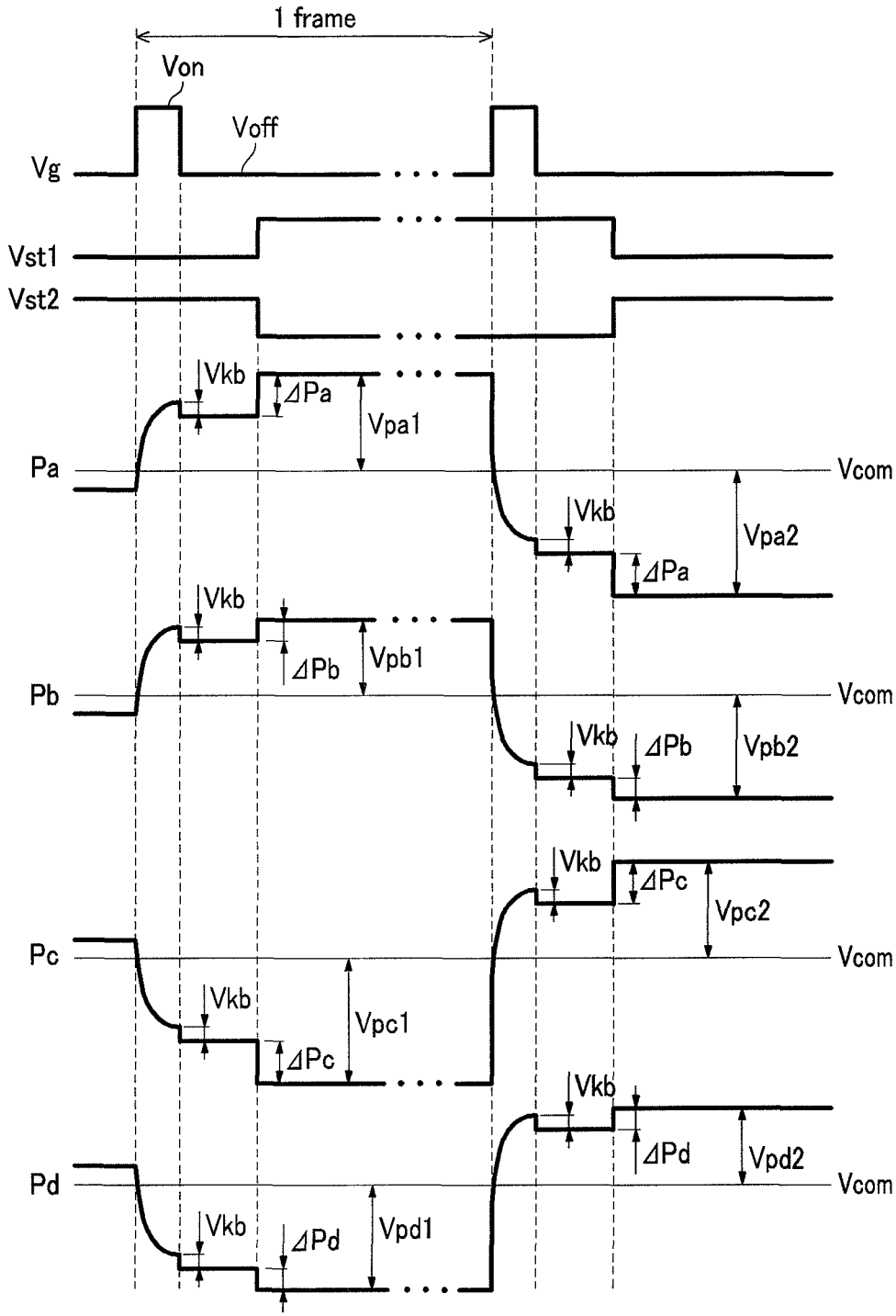
FIG. 4 is a waveform diagram of driving voltages for a liquid crystal display according to an exemplary embodiment of the present invention.

FIG. 4 is a waveform diagram of driving voltages for a liquid crystal display according to an exemplary embodiment of the present invention.

Referring to FIG. 1 first, the signal controller 600 receives input image signals R, G, and B and input control signals for controlling the display thereof from an external graphics controller (not shown). Each of the input image signals R, G, and B includes information about the luminance of a pixel PX. The luminance has a predetermined number of grays, for example, $1024=2^{10}$, $256=2^{8}$, or $64=2^{6}$. The input control signals include a vertical synchronization signal Vsync, a horizontal synchronizing signal Hsync, a main clock signal MCLK, and a data enable signal DE.

On the basis of the input control signals and the input image signals R, G, and B, the signal controller 600 processes the input image signals R, G, and B appropriately for an operation condition of the liquid crystal panel assembly 300, and generates gate control signals CONT1, data control signals CONT2, and a storage electrode control signal CONT3. The signal controller 600 sends the gate control signals CONT1 to the gate driver 400, sends the data control signal CONT2 and the processed image signals DAT to the data driver 500, and sends the storage electrode control signal CONT3 to the storage electrode driver 700. The output image signals DAT are digital signals having a predetermined number of values or grays.

Responsive to the data control signals CONT2 of the signal controller 600, the data driver 500 receives the digital image signals DAT for one row of pixels PX, converts the digital image signals DAT to analog data voltages selected from the gray voltages, and applies the analog data voltages to the data lines DL1 and DL2.

The gate driver 400 applies the gate-on voltage Von to a gate line GL according to the gate control signals CONT1 from the signal controller 600, thereby turning on the switching elements Qa, Qb, Qc, and Qd connected thereto. Then, the data voltages Vd applied to the data lines DL1 and DL2 are then applied to the subpixels PXa, PXb, PXc, and PXd through the switching elements Qa, Qb, Qc, and Qd, respectively.

In this exemplary embodiment, two subpixels PXa and PXb or PXc and PXd forming a pixel PX1 or PX2 receive the same data voltage Vd at the same time through the same data line DL1 or DL2, and two adjacent pixels PX1 and PX2 receive data voltages Vd having opposite polarities relative to the common voltage Vcom. The data voltages Vd applied to the two adjacent pixels PX1 and PX2, however, may have the same polarity. In this case, the two pixels PX1 and PX2 may be connected to the same storage electrode line SL1 or SL2, and one of the storage electrode lines SL1 and SL2 may be omitted.

For descriptive convenience, among two terminals of each of the capacitors Clca-Clcd and Csta-Cstd, a terminal connected to the switching elements Qa-Qd is referred to as a first terminal and the other is referred to as a second terminal. As described above, the first terminal of each of the liquid crystal capacitors Clca-Clcd is connected to the first terminal of a corresponding storage capacitor Csta-Cstd.

Referring to FIG. 4, voltages Pa and Pb of the first terminals of the capacitors Clca, Csta, Clcb and Cstb in the pixel PX1 rise at nearly the same rate to a predetermined level. On the other hand, the first terminal voltages Pc and Pd of the capacitors Clcc, Cstc, Clcd, and Cstd in the pixel PX2 fall to a predetermined level at substantially the same rate.

Thereafter, when the switching elements Qa, Qb, Qc, and Qd turn off, the first terminal of each capacitor Clca-Clcd, or Csta-Cstd becomes floating. Because the gate voltage Vg is changed to the gate-off voltage Voff from the gate-on voltage Von, the first terminal voltage Pa, Pb, Pc, or Pd drops by a kickback voltage Vkb.

Subsequently, the voltages of the first and second storage electrode lines SL1 and SL2 change to cause the first terminal voltages Pa, Pb, Pc, and Pd to be different from each other.

In more detail, the voltage variation of the second terminals of two storage capacitors Csta and Cstb or Cstc and Cstd in each pixel PX1 or PX2 are substantially the same. The first terminal voltages Pa and Pb or Pc and Pd become different because the capacitances of the two storage capacitors Csta and Cstb or Cstc and Cstd are different, however, from each other.

The variation ΔPk (k=a, b, c, d) of the first terminal voltage Pk is in proportion to Cstk/(Ct+Cstk), wherein Ct denotes the total capacitance of the other capacitors connected to the first terminal. For example, if Csta is larger than Cstb, ΔPa becomes larger than ΔPb because Csta/(Ct+Csta)>Cstb/(Ct+Cstb) as shown in FIG. 4. Likewise, if Cstc is larger than Cstd, ΔPc becomes larger than ΔPd as shown in FIG. 4.

Finally, the voltages Vpa1, Vpb1, Vpc1, and Vpd1 of the liquid crystal capacitors Clca, Clcb, Clcc, and Clcd become different through the above-described processes.

If a potential difference is generated across the liquid crystal capacitor Clca, Clcb, Clcc, or Clcd, an electric field is generated in the liquid crystal layer 3. Then, the major axes of the liquid crystal molecules of the liquid crystal layer 3 tilt in response to the electric field, and the polarization of the light incident on the liquid crystal layer 3 varies depending on the tilt angles of the liquid crystal molecules. The polarizer(s) (not shown) converts the light polarization into the light transmittance such that the liquid crystal display displays an image through the light transmittance.

The tilt angles of the liquid crystal molecules depend on the strength of the electric field. Because the voltages of two liquid crystal capacitors Clca and Clcb or Clcc and Clcd are different from each other, two subpixels PXa and PXb or PXc and PXd have different luminance. Therefore, the capacitances of two storage capacitors Csta and Cstb or Cstc and Cstd can be adjusted so that an image seen from a lateral side is the closest to an image seen from a frontal side, that is, a lateral gamma curve is the closest to a frontal gamma curve. Then, the lateral visibility can be improved.

By repeating this procedure by a unit of a horizontal period, also referred to as "1H" and equal to one period of the horizontal synchronization signal Hsync and the data enable signal DE, the data voltages Vd from the data driver 500 are applied to all pixels PX to display an image of a frame.

When the next frame starts after one frame finishes, the inversion control signal applied to the data driver 500 from the signal controller 600 is controlled such that the polarity of the data voltages for every pixel PX is reversed, which is referred to as "frame inversion".

Referring to FIG. 4, in the next frame, the polarity of the data voltage Vd applied to each of the pixels PX1 and PX2 is reversed, and the polarities of the storage electrode signals Vst1 and Vst2 are also reversed. Therefore, the direction of the voltage variation ΔPa, ΔPb, ΔPc, and ΔPd becomes reversed and the voltages across the liquid crystal capacitors Clca, Clcb, Clcc, and Clcd become Vpa2, Vpb2, Vpc2, and Vpd2.

Hereinafter, a liquid crystal display and a driving method thereof according to an exemplary embodiment of the present invention will be described in detail with reference to FIG. 5 and FIG. 6.

Figure 5:
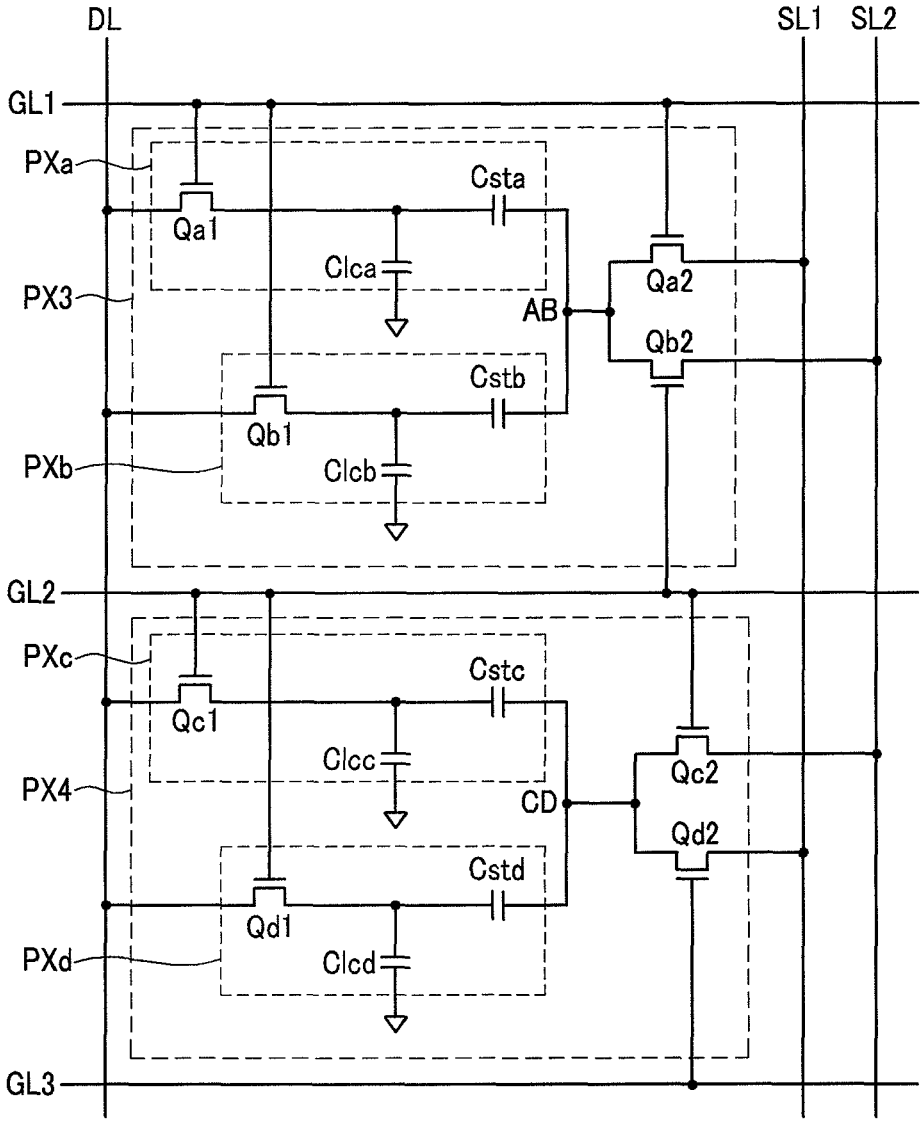
FIG. 5 is an equivalent circuit diagram of two pixels of a liquid crystal display according to an exemplary embodiment of the present invention.
Figure 6:
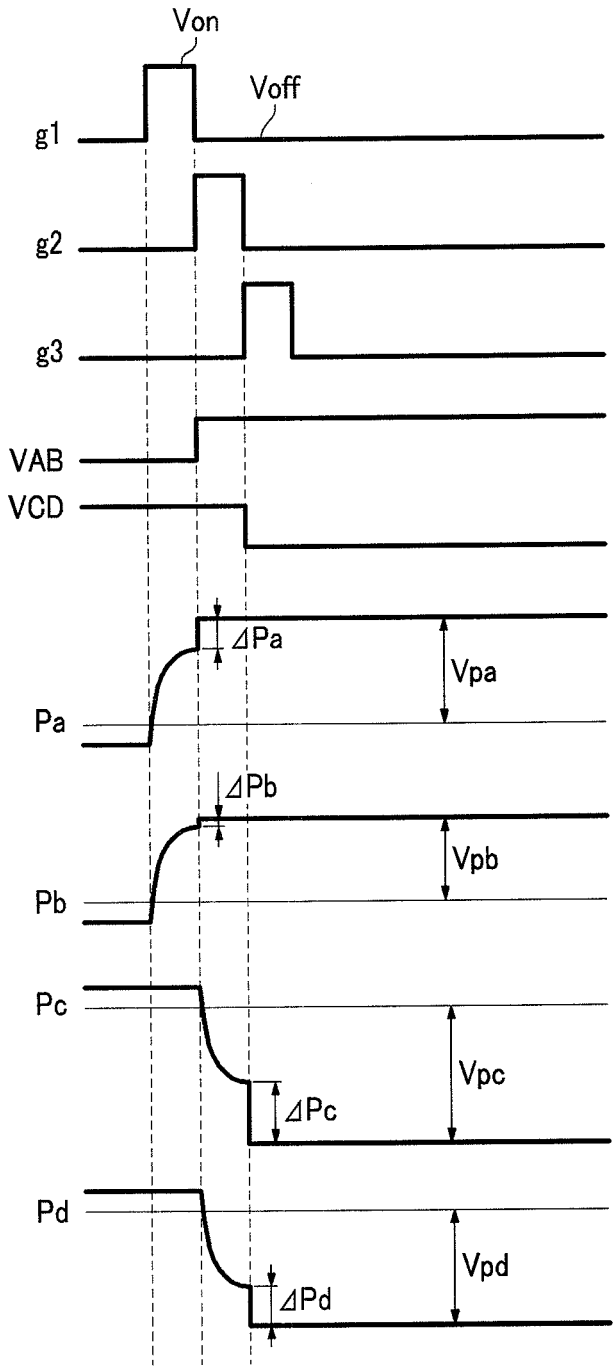
FIG. 6 is a waveform diagram of driving voltages for the liquid crystal display shown in FIG. 5.

FIG. 5 is an equivalent circuit diagram of two pixels of a liquid crystal display according to an exemplary embodiment of the present invention, and FIG. 6 is a waveform diagram of driving voltages for the liquid crystal display shown in FIG. 5.

Referring to FIG. 5, a liquid crystal display according to this exemplary embodiment includes a plurality of gate lines GL1, GL2, and GL3, a plurality of data lines DL, and a pair of first and second storage electrode lines SL1 and SL2. The first storage electrode line SL1 and the second storage electrode line SL2 may have different voltages, and the voltage of each of the first and second storage electrode lines SL1 and SL2 may sustain a constant value.

As in FIG. 3, each of pixels PX3 and PX4 includes two subpixels PXa and PXb or PXc and PXd. Each of the subpixels PXa, PXb, PXc, and PXd respectively includes a switching element Qa1, Qb1, Qc1, or Qd1 connected to a gate line GL1 or GL2 and a data line DL, and a liquid crystal capacitor Clca, Clcb, Clcc, and Clcd and a storage capacitor Csta, Cstb, Cstc and Cstd respectively connected to the switching element Qa1, Qb1, Qc1, and Qd1. The capacitances of the storage capacitors Csta and Cstb are different from each other, and the capacitances of the storage capacitors Cstc and Cstd are also different from each other.

Unlike what is shown in FIG. 3, each of the pixels PX3 and PX4 further includes two switching elements Qa2 and Qb2 or Qc2 and Qd2 respectively connected to different gate lines GL1 and GL2 and different storage electrode lines SL1 and SL2.

For example, one switching element Qa2 of the pixel PX3 has a control terminal connected to a gate line GL1, hereinafter, referred to as a current gate line, connected to the switching elements Qa1 and Qb1 of the pixel PX3, an input terminal connected to the first storage electrode line SL1, and an output terminal connected to the storage capacitors Csta and Cstb. The other switching element Qb2 has a control terminal connected to a lower gate line GL2, hereinafter, referred to as a next gate line, an input terminal connected to the second storage electrode line SL2, and an output terminal connected to the storage capacitors Csta and Cstb.

One switching element Qc2 of a pixel PX4 disposed below the pixel PX3 has a control terminal connected to a current gate line GL2, an input terminal connected to the second storage electrode line SL2, and an output terminal connected to the storage capacitors Cstc and Cstd. The other switching element Qd2 has a control terminal connected to the next gate line GL3, an input terminal connected to the first storage electrode line SL1, and an output terminal connected to the storage capacitors Cstc and Cstd.

In each of the pixels PX3 and PX4 of the liquid crystal display, one of the two switching elements Qa2 and Qb2 or Qc2 and Qd2 is turned on to sustain the voltage of the second terminal of the storage capacitors Csta and Cstb or Cstc and Cstd, while the liquid crystal capacitors Clca and Clcb or Clcc and Clcd and the storage capacitors Csta and Cstb or Cstc and Cstd are charged.

When the charging of the liquid crystal capacitors Clca and Clcb or Clcc and Clcd and the storage capacitors Csta and Cstb or Cstc and Cstd is finished and the switching element Qa2 or Qc2 becomes turned off, the other switching element is turned on to change the first terminal voltages Pa and Pb or Pc and Pd by the predetermined values ΔPa and ΔPb or ΔPc and ΔPd, thereby changing the voltages Vpa, Vpb, Vpc, and Vpd across the liquid crystal capacitors Clca and Clcb or Clcc and Clcd. Subsequently, the switching element Qb2 or Qd2 turns off to make a node AB or CD at the second terminal of the storage capacitors Csta and Cstb or Cstc and Cstd floating, thereby sustaining a voltage.

In FIG. 6, g1, g2, and g3 denote gate signals respectively flowing through the gate lines GL1, GL2, and GL3, VAB denotes the voltage of the node AB shown in FIG. 5, and VCD denotes the voltage of the node CD shown in FIG. 5.

In this way, the luminance of two subpixels in one pixel can be made different, while applying the same voltage to the storage capacitors of the two subpixels.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A liquid crystal display comprising:

a first gate line transmitting a first gate signal;

a first data line transmitting a first data voltage;

a second gate line transmitting a second gate signal;

a third gate line transmitting a third gate signal;

a first pixel including a first subpixel and a second subpixel and a second pixel including a third subpixel and a fourth subpixel;

a first storage electrode line having a first voltage; and a second storage electrode line having a second voltage that is different from the first voltage, wherein the first pixel is connected to the first gate line and the first data line, the first subpixel of the first pixel comprises a first switching element connected to the first gate line, a first liquid crystal capacitor connected to the first switching element, and a first storage capacitor having a first terminal connected to the first switching element and a second terminal, the second subpixel of the first pixel comprises a second switching element connected to the first gate line and the first data line, a second liquid crystal capacitor connected to the second switching element, and a second storage capacitor having a first terminal connected to the second switching element and a second terminal and having a capacitance different from a capacitance of the first storage capacitor, wherein the first pixel further comprises a third switching element connected to the first gate line, the first storage electrode line, and the first and second storage capacitors, and a fourth switching element connected to the second gate line, the second storage electrode line, and the first and second storage capacitors, wherein the second terminal of the first storage capacitor and the second terminal of the second storage capacitor are coupled to each other and having a varying voltage, wherein the third subpixel and the fourth subpixel of the second pixel are connected to the second gate line and the first data line, wherein the second pixel comprises a fifth switching element is connected to the second gate line, the second storage electrode line, and storage capacitors of the second pixel, and a sixth switching element connected to the third gate line, the first storage electrode line, and the storage capacitors of the second pixel.

2. The liquid crystal display of claim 1, wherein the voltage of the second terminals of the first and second storage capacitors is fixed while the first and second switching elements turn on to charge the first and second liquid crystal capacitors and the first and second storage capacitors, and varies after the charging of the first and second storage capacitors is finished.

3. The liquid crystal display of claim 2, wherein the voltage of the second terminals of the first and second storage capacitors rises when the voltage stored in the first and second liquid crystal capacitors and the first and second storage capacitors has a positive polarity, and drops when the voltage stored in the first and second liquid crystal capacitors and the first and second storage capacitors has a negative polarity.

4. The liquid crystal display of claim 3, further comprising:

a second data line transmitting a second data voltage; and a third pixel connected to the first gate line and the second data line and comprising a fifth subpixel and a sixth subpixel, wherein the fifth subpixel comprises a seventh switching element connected to the first gate line and the second data line, a third liquid crystal capacitor connected to the seventh switching element, and a third storage capacitor, and the sixth subpixel comprises an eighth switching element connected to the first gate line and the second data line, a fourth liquid crystal capacitor connected to the eighth switching element, and a fourth storage capacitor having a capacitance different from a capacitance of the third storage capacitor.

5. The liquid crystal display of claim 3, wherein the second terminals of the first and second storage capacitors alternate between a voltage-biased state and a floating state.

6. The liquid crystal display of claim 1, wherein the third switching element transfers the first voltage while the first and second liquid crystal capacitors and the first and second storage capacitors are charged, and the fourth switching element is turned on to transfer the second voltage after the third switching element is turned off.

7. The liquid crystal display of claim 6, wherein the third subpixel comprises a seventh switching element connected to the second gate line and the first data line, a third liquid crystal capacitor connected to the seventh switching element, and a third storage capacitor connected between the fifth switching element and the seventh switching element, and the fourth subpixel comprises an eighth switching element connected to the second gate line and the first data line, a fourth liquid crystal capacitor connected to the eighth switching element, and a fourth storage capacitor connected between the sixth switching element and the eighth switching element and having a capacitance different from a capacitance of the third storage capacitor.

8. The liquid crystal device of claim 7, wherein the fifth switching element transfers the second voltage while the third and fourth liquid crystal capacitors and the third and fourth storage capacitors are charged, and the sixth switching element turns on to transfer the first voltage after the fifth switching element is turned off.

9. The liquid crystal device of claim 8, wherein voltages of the first, second, and third gate lines vary sequentially.

10. A driving method of a liquid crystal device, comprising:

charging first and second liquid crystal capacitors and first and second storage capacitors with substantially the same voltage;

floating first terminals of the first liquid crystal capacitor and the first storage capacitor that are connected to each other, and first terminals of the second liquid crystal capacitor and the second storage capacitor that are connected to each other;

changing voltages of the second terminals of the first and second storage capacitors by substantially the same level to cause voltages of the first terminal of the first liquid crystal capacitor and the first terminal of the second liquid crystal capacitor to be differentiated, wherein during the charging, the voltages of the second terminals of the first and second storage capacitors are maintained at fixed values by activating a first switching element with a first gate line signal to provide a first storage electrode line signal to the second terminals of the first and second storage capacitors, and charging third and fourth liquid crystal capacitors and third and fourth storage capacitors with substantially the same voltage, wherein during the charging, the voltages of second terminals of the third and fourth storage capacitors are maintained at fixed values by activating a second switching element with a second gate line signal to provide a second storage electrode line signal to the second terminals of the third and fourth storage capacitors wherein a third switching element is configured to receive the second gate line signal and the second storage line signal and is connected to the second terminals of the first and second storage capacitors, and a fourth switching element is configured to receive a third gate line signal and the first storage electrode line signal and is connected to the second terminals of the third and fourth storage capacitors.

11. The driving method of claim 10, wherein a capacitance of the first storage capacitor is different from a capacitance of the second storage capacitor.

12. The driving method of claim 11, wherein the changing voltages comprises:

raising the voltages of the second terminals of the first and second storage capacitors when the first and second liquid crystal capacitors and the first and second storage capacitors are charged with a positive voltage, and lowering the voltages of the second terminals of the first and second storage capacitors when the first and second liquid crystal capacitors and the first and second storage capacitors are charged with a negative voltage.

13. The driving method of claim 12, further comprising:

floating the second terminals of the first and second storage capacitors after changing the voltages.

* * * * *